United States Patent [19]

Bosch et al.

[11] 4,375,269

[45] Mar. 1, 1983

[54] DISK-INDEXING MECHANISM FOR POWDER-ACTUATED TOOL ABSTRACT OF THE DISCLOSURE

[75] Inventors: Yves Bosch, St. Vallier; Jean Ollivier, Valence; Roland Almeras, Tournon, all of France

[73] Assignee: Olin Corporation, New Haven, Conn.

[21] Appl. No.: 158,766

[22] Filed: Jun. 12, 1980

[51] Int. Cl.[3] ..... B25C 1/14; B25C 1/18

[52] U.S. Cl. ..... 227/8; 227/10

[58] Field of Search ..... 227/8, 9, 10, 11

[56] References Cited

U.S. PATENT DOCUMENTS

| | | | |
|---|---|---|---|
| 2,930,041 | 3/1960 | Massacrier | 1/44.5 |
| 3,048,850 | 8/1962 | Schilling | 1/44.5 |
| 3,632,032 | 1/1972 | Termet | 227/10 |
| 3,923,225 | 12/1975 | Maier et al. | 227/8 |

FOREIGN PATENT DOCUMENTS

| | | | |
|---|---|---|---|
| 1923911 | 10/1971 | Fed. Rep. of Germany . | |
| 2017444 | 11/1971 | Fed. Rep. of Germany . | |
| 2031994 | 12/1971 | Fed. Rep. of Germany . | |
| 2044920 | 1/1972 | Fed. Rep. of Germany . | |
| 2263764 | 10/1973 | Fed. Rep. of Germany . | |
| 2426837 | 11/1975 | Fed. Rep. of Germany . | |
| 2758746 | 7/1979 | Fed. Rep. of Germany | 227/9 |

*Primary Examiner*—Paul A. Bell

*Attorney, Agent, or Firm*—Paul J. Lerner

[57] ABSTRACT

A magazine-indexing mechanism for a powder-actuated tool, of the type adopted for use with a disk-shaped cartridge magazine, is actuated by the same trigger displacement as actuates the firing mechanism. A first link, pinned to the receiver, and a second link, pinned to an extension of the trigger, are pinned together, with a magazine engaging hook disposed on the dictal end of the first link. When the trigger is pulled, as to fire the tool, the hook is displaced to engagement with the magazine. When the trigger is released, the engaged hook is displaced, indexing the magazine. Means are also provided to prevent indexing an unfired cartridge through the tool.

7 Claims, 12 Drawing Figures

DISK-INDEXING MECHANISM FOR POWDER-ACTUATED TOOL ABSTRACT OF THE DISCLOSURE

BACKGROUND AND SUMMARY OF THE INVENTION

The present invention relates to powder actuated tools and, more specifically, to a method and a means for indexing a pre-loaded charge-carrying member so as to remove fired charges from the firing position and to introduce unfired ones therein.

Powder-actuated tools, of the general type employing pre-loaded power charge magazines, and, more specifically, of the type employing disk-shaped members fixedly carrying a number of cartridges projecting from a planar carrier, are known in the art. In such known tools, indexing of the charge magazine, especially the disk-type magazine, is accomplished by manipulation of an operating handle or through the action of a cam on, or cooperating with, a reciprocally mounted tool barrel. Tools of the first type are, however, seen to suffer in that magazine indexing adds another, inconvenient, step to the loading and firing sequence. Likewise, tools of the second type are seen to suffer in that pressing of the tool barrel against the work surface in preparation for firing, results in indexing of the magazine, even in the absence of trigger manipulation to fire the tool. Thus, if the user of this type of tool prepares to fire and then removes the tool from the work surface without having pulled the trigger, a live charge is indexed through the tool. The user must then discard the unused charge, a practise wasteful of material, or manually reposition the magazine, an awkward and inconvenient process. Further, in both of these types of tools, the indexing mechanisms are located in those tool areas most subject to accumulation of fouling matter, whereby the indexing mechanism may become difficult or, ultimately, impossible to operate.

It is, therefore, a primary object of the present invention to provide a powder-actuated tool of the aforementioned general type having magazine indexing means which will prevent indexing of an unfired charge through the tool.

It is a further object to provide such a tool wherein the indexing means is disposed in those tool areas least subject to fouling.

It is another object to provide such a tool wherein the indexing means is safe, comparatively simple in construction and highly reliable in use.

These objects are achieved, in general, by a tool wherein the indexing means is actuated by the same trigger displacement as actuates the firing mechanism. More specifically, means are provided for engaging the magazine which means is displaced from an initial position of engagement with a predetermined portion of the magazine consequent to a displacement of the trigger to fire the tool and is returned to the initial position, drawing the predetermined magazine portion therewith, consequent to the return of the trigger to its initial position. This return may be effected, most advantageously, by a spring which is loaded during the initial trigger movement.

In particular, the above-described motions of the magazine engaging means may be effected by a first rigid link, rotatably carried by the tool receiver, and a second rigid link member, rotatably carried by an extension formed on the trigger member; the links being rotatably pinned together, with the engagement means being disposed on a distal end of the first link. The engagement means may conveniently comprise a hook member adopted for abuttment against the portion of one of the cartridges projecting from the carrier, although oter means are within the contemplation of the present invention.

For keeping with the primary object of the invention, there is provided means for preventing indexing of the magazine unless the tool is pressed against the work surface preparatory to firing such that the reciprocally mounted barrel has been displaced to its rearwardmost position. This means may comprise means for constraining displacement of the aforementioned linkage. One such constraining means advantageously comprises an extension of the hinge pin, pining the two links, which extension is constrained to move in a recess, formed in the firing mechanism cocking slide, which slide is arranged for displacement in conjunction with the barrel. Alternatively, means may be provided to alter the configuration of the linkage so as to render the same incapable of effecting displacement of the magazine. One such means advantageously comprises a slot, formed in the receiver and adapted slidably and rotatably to receive the hinge pin of the first link, which slot is blocked, to prevent sliding of the pin, by an extension of the socking slide when the same is in its rearwardmost position, whereby the pivot point of the link is determined.

BRIEF DESCRIPTION OF THE DRAWINGS

The above and other objects and advantages of the present invention, as may hereinafter appear, may be more clearly understood by reference to the claims, the detailed descriptions of the preferred embodiments and the drawings, wherein:

DETAILED DESCRIPTION OF THE PREFERRED EMBODIMENTS

Figure 1:
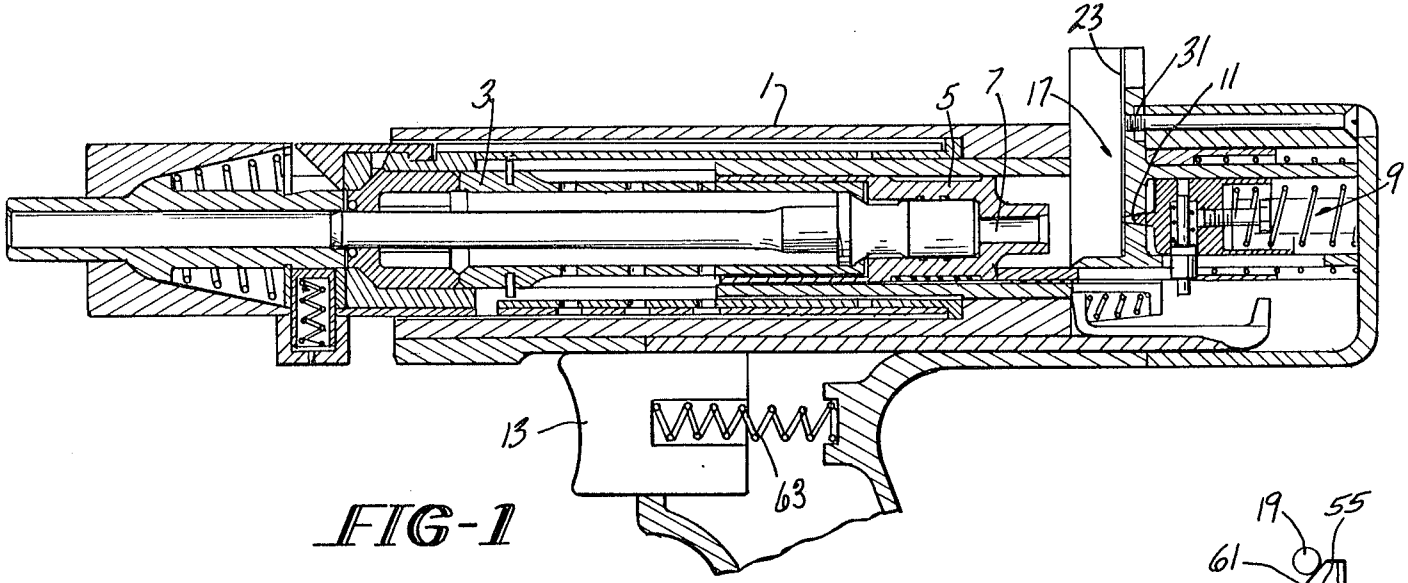
FIG. 1 is a side cross sectional view of a powder-actuated tool arranged and constructed in accord with the present invention.
Figure 8:
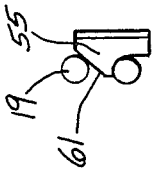
FIG. 8 is an enlarged, fragmentary plane view of the engagement means of the mechanism of FIGS. 2–7.
Figure 2:
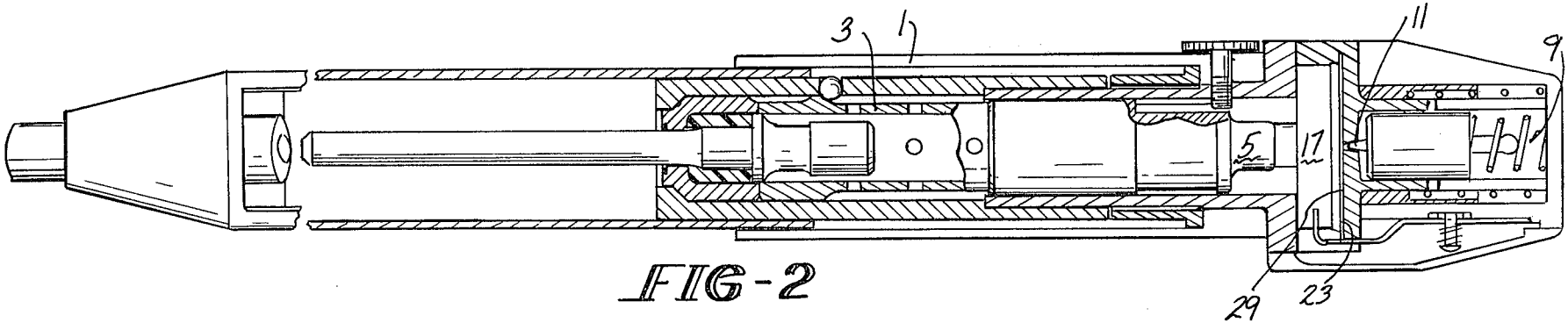
FIG. 2 is a top cross-sectional view of the tool of FIG. 1.

Turning now to the drawings, there is shown, in FIG. 1, a powder-actuated tool comprising a receiver 1, a barrel 3 reciprocatly mounted in receiver 1, for movement between a forward position and a rearward position, means 5 defining a cartridge-receiving chamber 7 at the breech end of barrel 3 and firing means, devoted generally 9 and including a firing pin 11, actuable by a trigger 13 movable between a forward position and a rearward position, to fire a cartridge disposed in chamber 7.

The tool is specifically adapted for use with a removable pre-loaded cartridge magazine 15 and, to this end, includes a magazine-receiving recess 17 formed in receiver 1. Magazine 15, which comprises a plurality of cartridges 19 disposed at regularly spaced intervals about the periphery of a disk-shaped steel carrier 21, is retained in a U-shaped groove 23, formed in the sides 25 and bottom 27 of recess 17, which movably engages the peripheral edge of carrier 21, radially outwardly of cartridges 19. Magazine 15 is further supported by a planar rear surface 29 of recess 17 and is urged thereagainst by magnets 31. A lip 33 overhangs groove 23 and serves to retain magazine 15 therein. It should be readily appreciated, therefore, that magazine 15 is rotatable, in receiver 1, so as to permit the seguential introduction of cartridges 19 between chamber 7 and firing pin 11.

Figure 6:
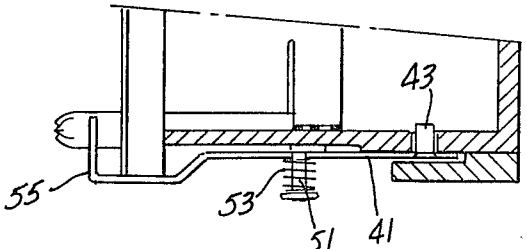
FIG. 6 is an enlarged, fragmentary top cross-sectional view of linkage of FIGS. 2–7.
Figure 7:
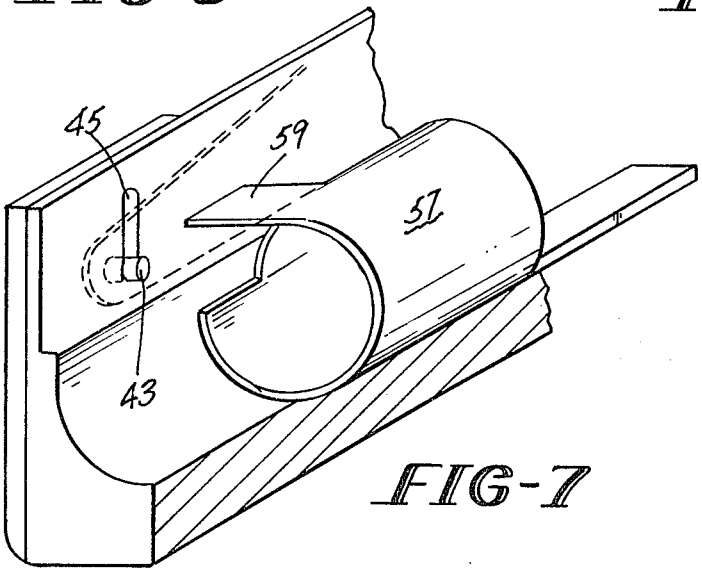
FIG. 7 is an enlarged, fragmentary perspective view showing the hinge pin, hinge pin slot and socking slide of the mechanism of FIGS. 2–5.

Step-wise rotation of magazine 15 is accomplished by means of a trigger-actuable mechanism comprising a first rigid link 41, rotatably and slidably connected proximate one end thereof, to receiver 1 by a pin 43, which engages a receiver slot 45, and a second rigid link 47, rotatably pinned, at one end, to an extension 49 of trigger 13 and likewise connected, at the other end, to first link 41, proximate the mid-point thereof, by a pin 51. As best seen in FIG. 6, the connection between first and second links, 41 and 47 respectively, is such as to permit limited sidewise displacement of first link 41, which displacement is opposed by spring 53. Engagement means, comprising a hook member 55 adapted to abuttingly engage the projecting portion of a cartridge 19, is formed on the distal end of first link 41. A substantially cylindrical cocking slide 57 is sliding disposed between barrel 3 and firing means 9 and constrained to reciprocate therewith. An extension 59, formed on cocking slide 57, is adapted to block slot 45, consequent to a rearward displacement of barrel 3, for reasons which will become apparent.

Figure 3:
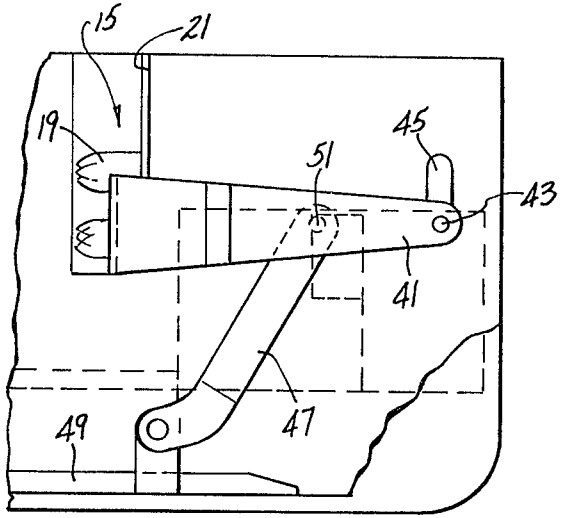
FIG. 3 is an enlarged, fragmentary cross-sectional view of the magazine-indexing mechanism of the tool of FIG. 1 showing the mechanism in the rest position with the tool unready for firing

In FIG. 3, the magazine-indexing mechanism is shown in its rest position, unready for firing, with both barrel 3 and trigger 13 in their forward positions.

Figure 5:
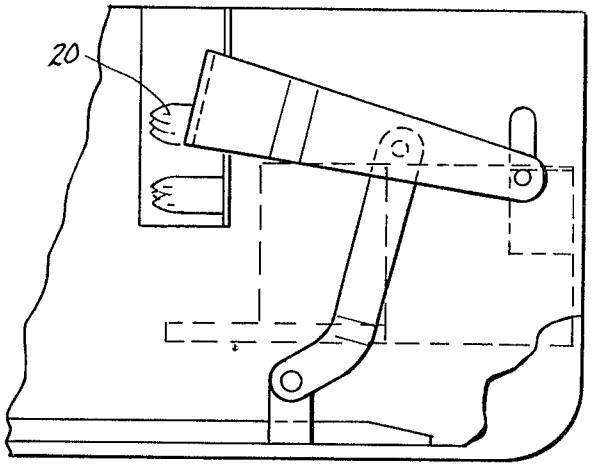
FIG. 5 is a view similar to FIGS. 3 and 4, showing the mechanism in the upward cartridge-engaging position.

As seen in FIG. 5, the tool has been cocked, by pressing the muzzle of barrel 3 againt the work surface, displacing cocking slide 57 rearwardly, whereby cocking slide extension 59 blocks receiver slot 45, locking pin 43 at the base thereof. Subsequent to cocking, trigger 13 has been displaced rearwardly, as to discharge the tool, causing an upward or clockwise rotation of first link 41, about pin 43, under the influence of second link 47 and trigger extension 49, to a position where hook member 55 overhangingly abuts the projecting portion of a predetermined cartridge 20. In the course of this rotation, first link 41 was momentarily displaced sidewardly as a cam surface 61, on hook member 55, rode along a lower surface of now engaged cartridge 20.

Trigger 13 is now released and returns to its forward position under the influence of a trigger spring 63, loaded during the initial trigger movement. Hook member 55 is thus urged downwardly to its rest position, drawing therewith engaged cartridge 20, thereby rotatably indexing magazine 15.

Figure 4:
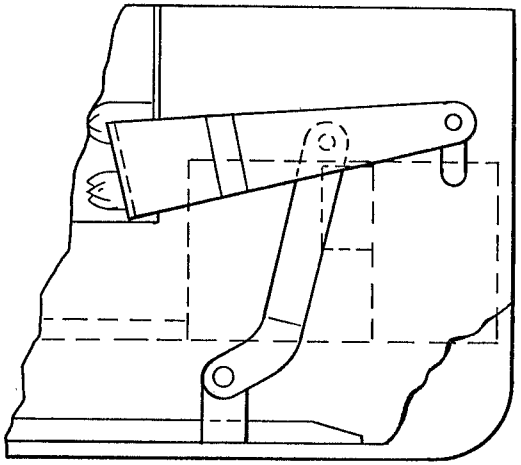
FIG. 4 is a view similar to FIG. 3, the mechanism having been activated with the tool unready for firing.

In the event that trigger 13 is displaced prior to cocking of the tool, receiver slot 45 is unobstructed (See FIG. 4) allowing pin 43 to freely rise therein, as first link 4 rotates counter-clockwise about pin 51, whereby magazine 15 remains unaffected.

Figure 12:
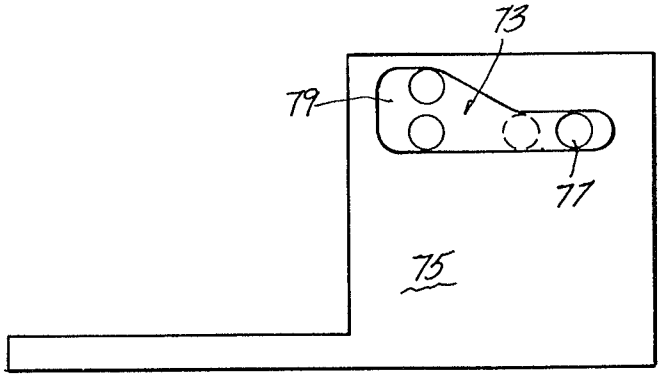
FIG. 12 is an enlarged plane view of the cocking slide of the mechanism of FIGS. 9–11.
Figure 11:
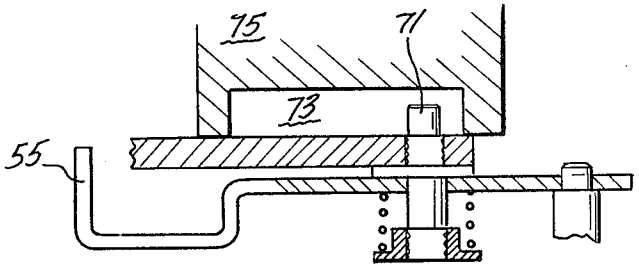
FIG. 11 is an enlarged, fragmentary top cross-sectional view of the mechanism of FIGS. 9 and 10.

Turning now to FIGS. 9–12, there is shown an alternate embodiment of the magazine-indexing mechanism, wherein first link 41 is nonslidably pinned to receiver 1 and spin-loaded pin 51 is formed with an extension 71 constrained to move in a recess 73 formed in the cocking slide 75 which, in this embodiment of the invention, has substantially planar sides. As best seen in FIG. 12, recess 73 comprises a lower rearward portion 77 opening into a higher forward portion 79.

Figure 9:
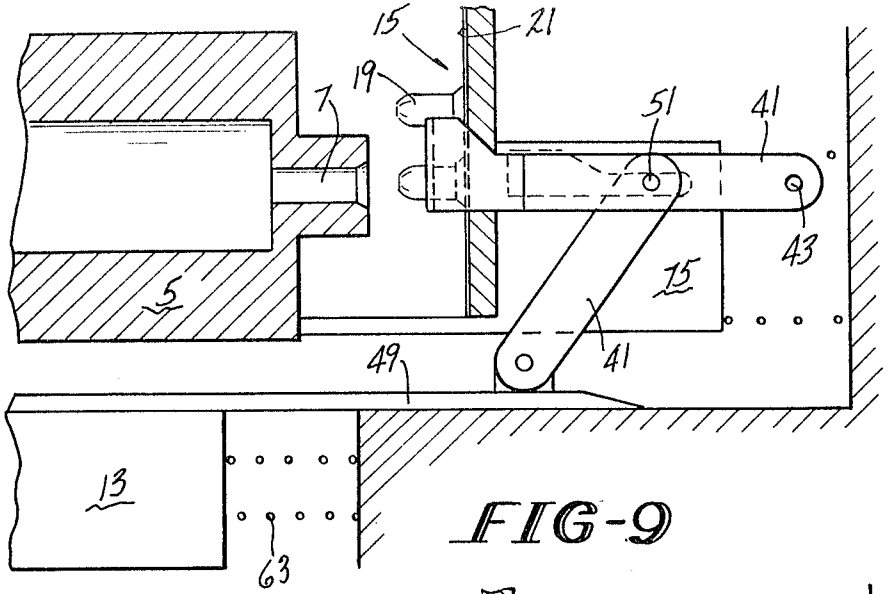
FIG. 9 is an enlarged, fragmentary cross-sectional view of an alternate embodiment of the magazine-indexing mechanism, showing the mechanism in the rest position with the tool unready for firing.

For FIG. 9, an alternate embodiment of the magazine-indexing mechanism is shown in its rest position, unready for firing, with both barrel 3 and trigger 13 in their forward positions. Cocking slide 75 is also in its forward position, with pin extension 71 in rearward portion 77 of recess 73.

Figure 10:
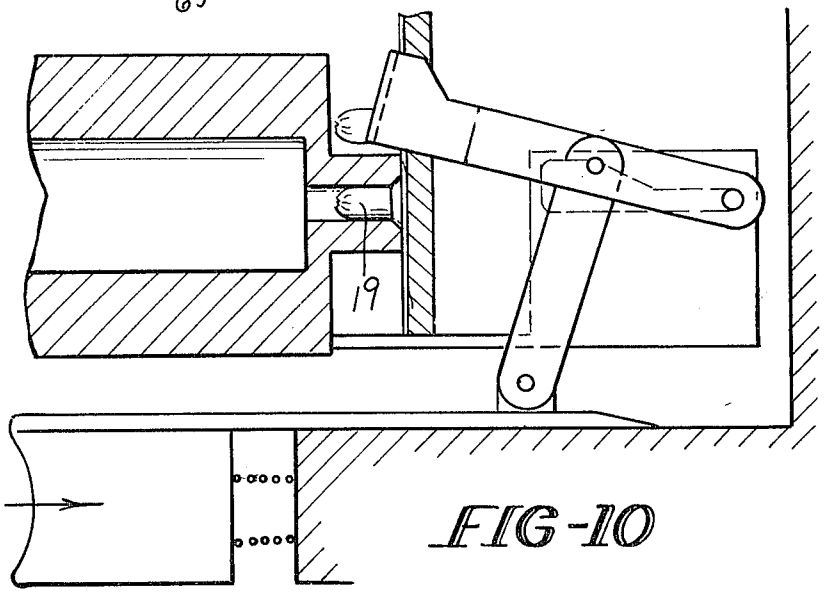
FIG. 10 is a view similar to FIG. 9, the mechanism having been activated, with the tool ready for firing.

As seen in FIG. 10, the tool has been cocked, displacing cocking slide 75 rearwardly, whereby pin extension 71 is now in forward portion 79 of recess 73. Subsequent to cocking, trigger 13 has been displaced rearwardly, as to discharge the tool, causing an upward or clockwise rotation of first link 41 about pin 43, which rotation is possible by reason of the greater height of forward recess portion 79. It is to be noted, therefore, that rearward displacement of trigger 13 is impossible prior to cocking of the tool.

While the preferred embodiments have been described and illustrated with reference to cartridges and a disk-shaped carrier, caseless charges, or pellets, and carriers of other configurations, may also be utilized. Likewise, it should be readily apparent that various other modifications of parts, and charges in arrangements thereof, may be made without departing from the spirit and contemplation of the invention which is intended to be limited in scope only by the appended claims.

We claim:

1. In a powder-actuated tool of the type comprising:

a. a receiver;

b. a barrel reciprocally mounted in said receiver for movement between a forward position and a rearward position;

c. means defining a charge-receiving chamber in the breech end of said barrel;

d. a trigger mounted in said receiver and movable irrespective of the position of said barrel;

e. firing means, including a firing pin, actuable by said trigger to fire a charge disposed in said chamber;

f. means in said receiver defining a support for a removable charge magazine loaded with a plurality of charges, said magazine being movable in said support means so as to permit the sequential introduction of said charges between said chamber and said firing pin;

g. means for engaging said magazine at a predetermined point; and h. means operably connecting said trigger to said engagement means to displace said magazine in step-wise manner to effect said sequential charge introduction;

the improvement comprising: means for rendering said displacing means inoperative unless said barrel is in said rearward position.

2. The invention of claim 1, wherein said magazine comprises a disk-shaped carrier and a plurality of cased cartridges disposed at regularly spaced intervals about the periphery thereof, said cartridges projecting from the plane of said carrier, and said engagement means comprises a hook member adapted for abutment against a projecting portion of one of said cartridges.

3. The invention of claim 2, wherein said carrier is formed of a ferrous material and said support means further comprises at least one magnet, disposed proximate said planar surface of said recess, adapted to urge said carrier thereagainst.

4. The invention of claim 1, wherein said displacement means comprises a first link member rotatably and displaceably carried by said receiver, a trigger extension member extending from said trigger, and a second link member rotatably carried by said trigger extension, said first and second link members being rotatably connected.

5. The invention of claim 4, wherein said hook member is disposed on a distal end of said first link member.

6. The invention of claim 5, wherein said means for rendering said displacing means inoperative comprises means operable to displaceably fix the end of said first link opposite said end thereof bearing said hook when said barrel is in said rearward position.

7. The invention of claim 4, wherein said means for rendering said displacing means inoperative comprises means operative to bar rotation of said first link unless said barrel is in said rearward position.

* * * * *